US006491652B1

(12) United States Patent
Hata et al.

(10) Patent No.: US 6,491,652 B1
(45) Date of Patent: Dec. 10, 2002

(54) MASSAGE DEVICE WITH FLEXIBLE SUPPORT STRAPS

(75) Inventors: Hitoshi Hata, Katano (JP); Shigeru Dono, Osaka (JP); Yukihiko Kitano, Nishinomiya (JP); Masamichi Miyaguchi, Hikone (JP); Shinji Tsutsui, Hikone (JP); Yuichi Nishibori, Hikone (JP); Toshiaki Nanno, Hikone (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 09/472,208

(22) Filed: Dec. 27, 1999

(30) Foreign Application Priority Data

May 14, 1999 (JP) ..... 11-134695
May 14, 1999 (JP) ..... 11-134696

(51) Int. Cl.[7] ..... A61H 19/00
(52) U.S. Cl. ..... 601/151; 601/148
(58) Field of Search ..... 601/148, 149–150, 601/151, 133, 27, 28, 31, 32, 11, 23, 24, 34; 602/13; 128/DIG. 20; 5/120, 590

(56) References Cited

U.S. PATENT DOCUMENTS 4,991,222 A * 2/1991 Nixdorf ..... 381/188
5,022,385 A * 6/1991 Harza ..... 128/33
5,054,854 A * 10/1991 Pruit ..... 297/284
5,072,724 A * 12/1991 Marcus ..... 128/66
RE34,883 E * 3/1995 Grim ..... 602/13
5,395,162 A * 3/1995 Jay et al. ..... 297/452.25
5,567,015 A * 10/1996 Arias ..... 297/397
6,203,510 B1 * 3/2001 Takeuchi et al. ..... 601/152

FOREIGN PATENT DOCUMENTS

JP 41 00 80453 A * 3/1998 ..... A61H/7/00
JP 10 21 6188 A * 8/1998 ..... A61H/9/00
JP 10 30 5068 A * 11/1998 ..... A61H/7/00

* cited by examiner

*Primary Examiner*—Justine R. Yu
(74) *Attorney, Agent, or Firm*—Oblon, Spivak, McClelland, Maier & Neustadt, P.C.

(57) ABSTRACT

A massage device capable of applying favorable pressure stimulation owing to expansion and shrinking of air bags irrespective of thickness of portions to be massaged such as legs or arms. The massage device has supporting bodies, strap bodies made of pliable material that are attached to the supporting bodies at their ends to form U-shaped sections, air bags provided at inner surfaces of strap bodies for receiving portions of a human body such as legs or arms to be massaged, and an air supply means for expanding and shrinking of the air bags. Upon locating portions to be massaged on the strap bodies, the strap bodies assume shapes that fit along the shapes of the portions of the body to be massaged to thus support the portions to be massaged on the strap bodies. Pressuring stimulation can then be applied to the portions to be massaged by making the air bags perform expansion and shrinking.

27 Claims, 14 Drawing Sheets

MASSAGE DEVICE WITH FLEXIBLE SUPPORT STRAPS

BACKGROUND OF THE INVENTION

1. Field of the Invention

The present invention relates to a massaging device for performing massage of a human body by performing expansion and shrinking of air bags.

2. Description of the Prior Art

A massaging device for performing massage of legs or arms by performing expansion and shrinking of air bags is disclosed in Japanese Patent Application Laid-Open Publication No. 8-89540(1996). This device is arranged, as shown in FIG. 31, in that concaved grooved portions 91 for receiving portions of a human body to be massaged such as legs or arms are formed at a body 90, and in that air bags 92, 92 are respectively attached to inner surface on the right and left of the concaved groove portions 91 wherein the portions to be massaged located at the concave portions 91 are stimulated through pressurizing by making the air bags 92, 92 perform expansion and shrinking.

The concaved groove portions 91 that are formed in the body 90 made of rigid material are required to assume a large width in view of large individual differences in thickness of arms or legs of human bodies. Thus, in performing pressurizing stimulation of portions to be massaged such as arms or legs by performing expansion and shrinkage of the air bags 92, feelings of massage of a person having thick portions to be massaged and those of a person having thin portions to be massaged differ from each other. Further, it is difficult to provide a massage device that can be concurrently used for legs and for arms.

SUMMARY OF THE INVENTION

Thus, it is an object of the present invention to provide a massage device that can perform pressurizing stimulation In a favorable manner by performing expansion and shrinking of air bags irrespective of thickness of portions to be massaged.

It is another object of the present invention to provide a massage device with which a person can easily be massaged and with which high massaging effects can be achieved.

A massage device according to one preferred embodiment of the present invention is comprised of supporting bodies, strap bodies formed of pliable material and which both ends are respectively attached to the supporting body such that they assume U-shaped sections, air bags that are arranged at inner surface sides of the strap bodies for receiving portions of a human body to be massaged such as legs or arms, and an air supply means for making the air bags perform expansion and shrinking.

In such a massage device, in case portions to be massaged are located in the concaved groove portions that are formed by the strap bodies for of pliable material, the strap bodies are made to assume shapes that fit along shapes of the portions to be massaged to thus hold the portions to be massaged on the strap bodies. By performing expansion and shrinking of the air bags in this condition, pressurizing stimulation can be applied to the portions to be massaged irrespective of thickness of the portions to be massaged.

These and other objects and many of the attendant advantages of this invention will be readily appreciated as the same becomes better understood by reference to the following detailed description when considered in connection with the accompanying drawing.

DESCRIPTION OF THE PREFERRED EMBODIMENTS

Figure 1A:
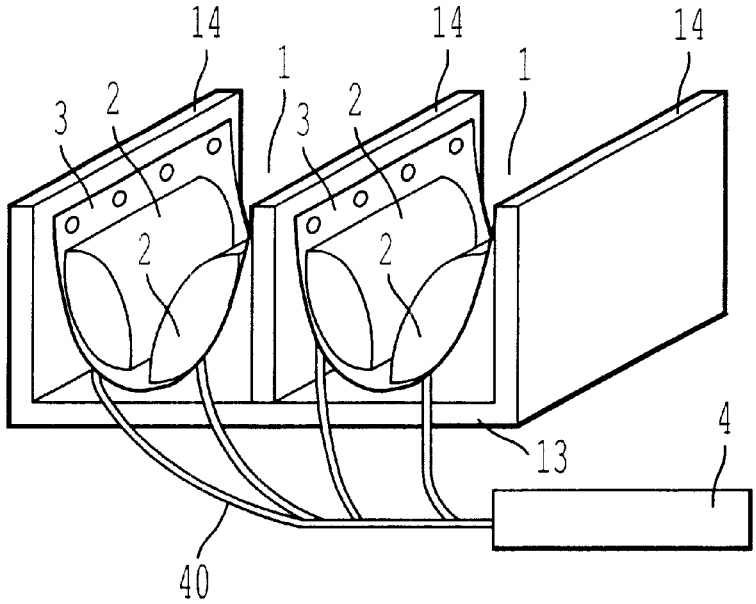
FIG. 1 is a view showing an embodiment of the present invention wherein (a) is a diagonal view, (b) a developed view of the air bags, and (c) a front view. showing a condition of use.
Figure 1B:
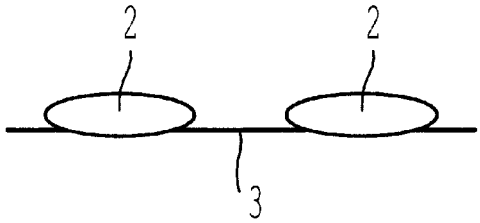
Figure 1C:
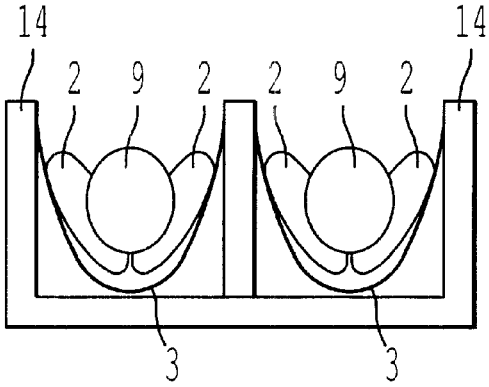
Figure 2A:
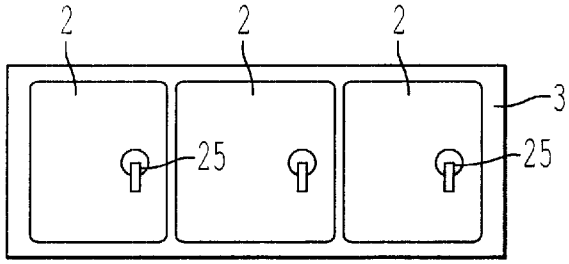
FIG. 2 is a view showing strap bodies and air bags according to another embodiment of the present invention wherein (a) is a developed plan view, (b) a developed sectional view, (c) a sectional view showing a condition of use, (d) a developed sectional view at the time of expansion, and (e) a sectional view showing a condition of use at the time of expansion.
Figure 2B:
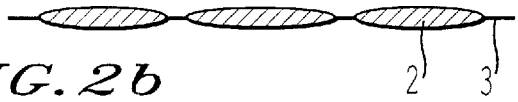
Figure 2C:
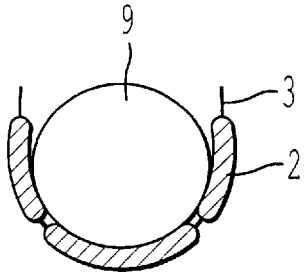
Figure 2D:
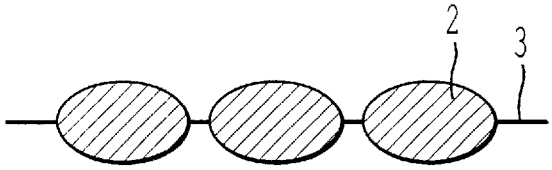
Figure 2E:
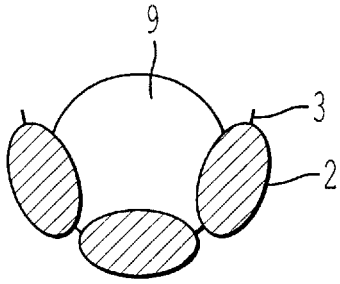

Embodiments of the present invention will now be explained. The massage device as shown in FIG. 1 is designed for massaging calf portions of both legs of a human body. Three plate-like supporting bodies 14 are arranged in a rising manner from a bottom plate 13 at specified distances and in a substantially parallel manner. Respective end portions on both sides of strap bodies 3, 3 formed of pliable material such as fabric or urethane mat are fixed to upper portions of respective neighboring supporting bodies 14, 14 and are suspended as to form U-shaped sections.

Air bags 2 for massaging are respectively attached to opposing right and left lateral surfaces at inner surfaces of each strap body 3. These air bags 2 are connected to an air supply means 4 including an air pump and a discharge valve by means of pipes 40.

Each of the strap bodies 3 contact the supporting bodies 14 only at their end portions and remaining portions hang in the air. Thus, in case portions to be massaged 9 are located on the concaved groove portions 1 that are formed by the strap bodies 3 having U-shaped sections, the strap bodies 3 are deformed owing to their pliable characteristics so as to fit along outer shapes of the portions to be massaged 9. Therefore, by making the air bags 2 expand, the portions to be massaged 9 can be surrounded from the right and left irrespective of the thickness of the portions to be massaged 9 such that suitable stimulation can be applied thereto.

Figure 3A:
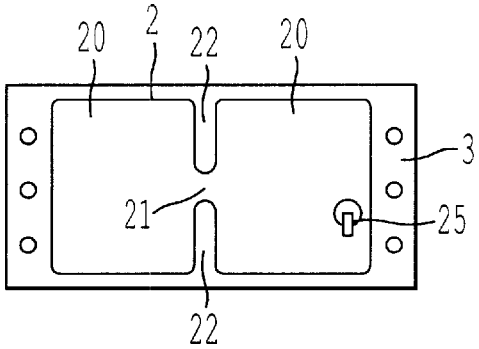
FIGS. 3(*a*)(*b*) are respectively a developed plan view showing strap bodies and air bags according to still another embodiment.
Figure 3B:
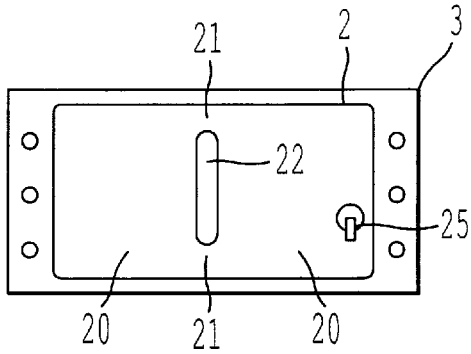
Figure 4A:
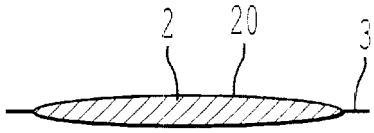
FIGS. 4(*a*)(*b*)(*c*)(*d*) are a developed sectional view of the strap bodies and air bags as shown in FIG. 3, a sectional view showing a condition of use, a developed sectional view at the time of expansion and a sectional view showing a condition of use at the time of expansion.
Figure 4C:
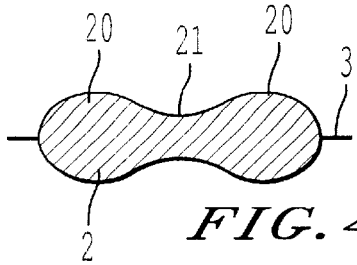
Figure 4B:
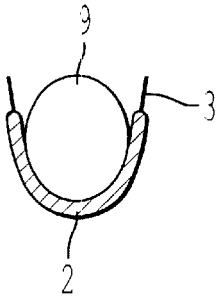
Figure 4D:
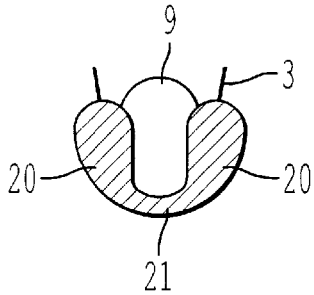
Figure 5A:
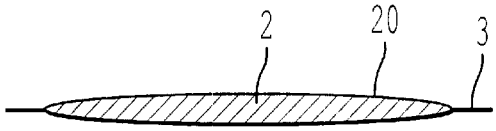
FIG. 5 is a view showing strap bodies and air bags according to still another embodiment, wherein (a) is a developed sectional view, (b) a sectional view showing a condition of use, (c) a developed sectional view at the time of expansion, and (d) a sectional view showing a condition of use at the time of expansion.
Figure 5C:
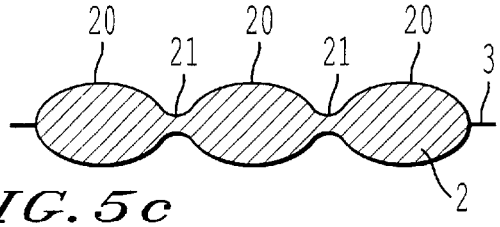
Figure 5B:
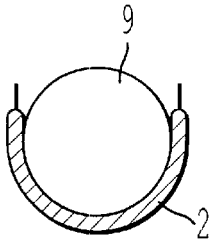
Figure 5D:
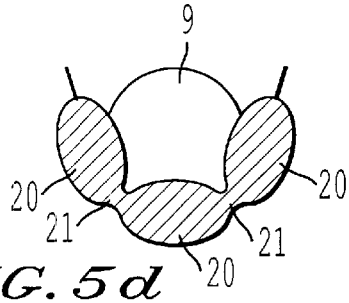

Each strap body 3 may be formed with three air bags 2 on the right and left and at the center, as shown in FIG. 2. In the drawing, 25 denote apertures to which pipes are connected. It is also possible to employ an arrangement in which a single air bag 2 is provided that extends from the right to the left in a bridging manner. In this case, piping arrangements can be simplified. However, in case of providing a single air bag 2, it is preferable to employ an air bag including two right and left air chambers 20, 20 that are connected to each other as shown in FIG. 3 and FIG. 4, or an air bag including three right and left air chambers 20, 20, 20 that are connected to each other as shown in FIG. 5.

In these cases, sectional areas of each of air passages 21 that perform connecting between each of the air chambers 20 are made to be smaller than sectional areas of each of the air chambers 20. With this arrangement, force which forces each air bag. 2 assume a plate-like shape is weakened so that fit between the air bags 2 and the portions to be massaged 9 can be improved. Consequently, the portions to be massaged 9 can be prevented from being lifted but enclosed by the air bags 2 so that suitable massaging can be performed. It should be noted that such air passages 21 of small sectional areas could be easily formed by forming thermocompression-bonded portions 22 or the like at the air bags as shown in FIG. 3.

Figure 6A:
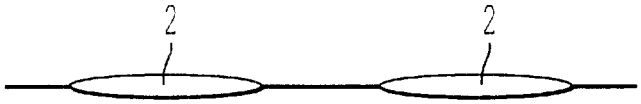
FIG. 6 is a view showing strap bodies and air bags according to still another embodiment, wherein (a) is a developed sectional view and (b) a developed sectional view at the time of expansion.
Figure 6B:
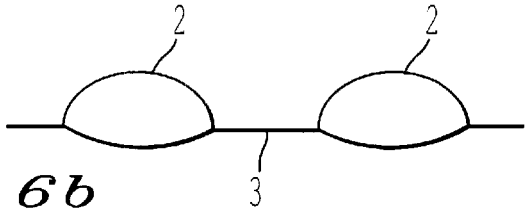
Figure 7A:
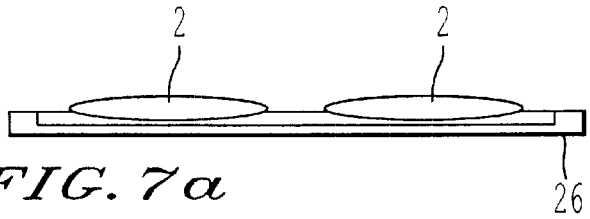
FIG. 7 is a view showing strap bodies and air bags according to still another embodiment, wherein (a) is a developed sectional view, (b) a sectional view showing a condition of use, (c) a developed sectional view at the time of expansion, and (d) a sectional view showing a condition of use at the time of expansion.
Figure 7B:
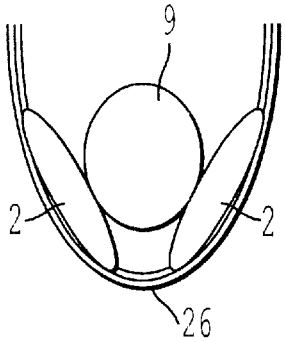
Figure 7C:
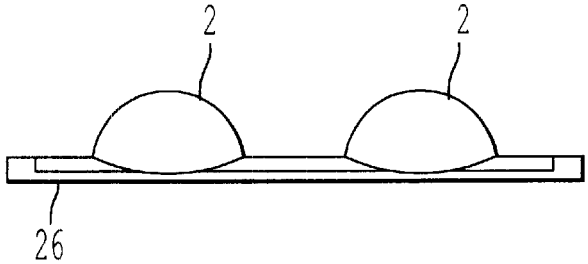
Figure 7D:
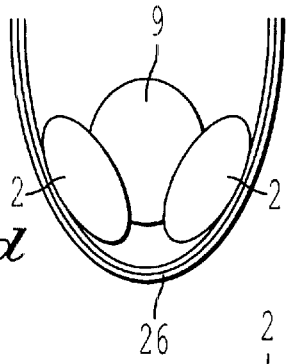
Figure 8A:
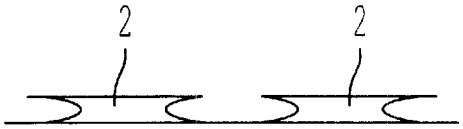
FIG. 8 is a view showing strap bodies and air bags according to still another embodiment, wherein (a) is a developed sectional view, (b) a sectional view showing a condition of use, (c) a developed sectional view at the time of expansion, and (d) a sectional view showing a condition of use at the time of expansion.
Figure 8C:
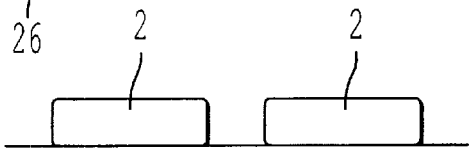
Figure 8B:
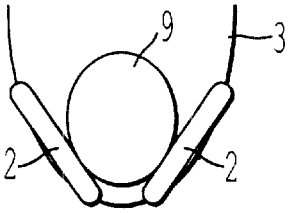
Figure 8D:
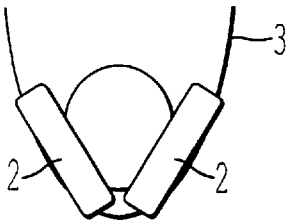
Figure 9A:
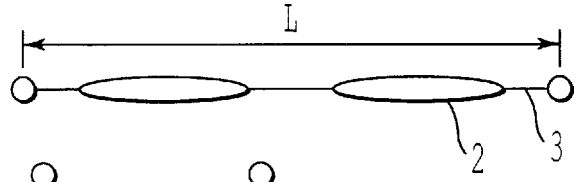
FIG. 9 is a view showing strap bodies and air bags according to still another embodiment, wherein (a) is a developed sectional view, (b) a sectional view showing a condition of use, (c) a developed sectional view at the time of expansion, (d) a sectional view. showing a condition of used at the time of expansion, and (e) an explanatory view for explaining actions accompanying variations in entire length of the strap bodies.
Figure 9B:
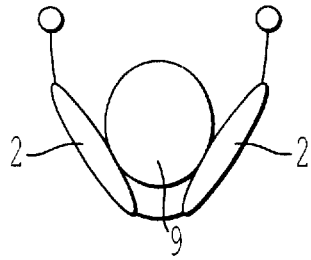
Figure 9C:
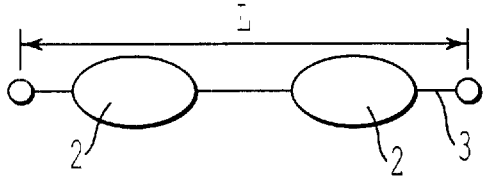
Figure 9D:
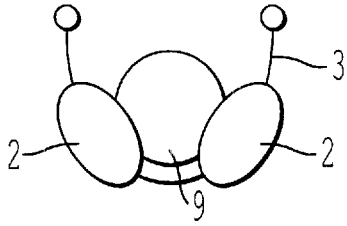
Figure 9E:
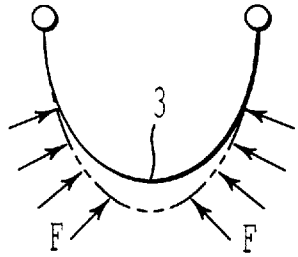
Figure 10A:
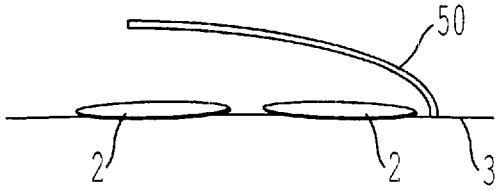
FIG. 10 is a view showing strap bodies and air bags according to still another embodiment, wherein (a) is a developed sectional view, (b) a sectional view showing a condition of use, (c) a developed sectional view at the time of expansion, and (d) a sectional view showing a condition of use at the time of expansion.
Figure 10C:
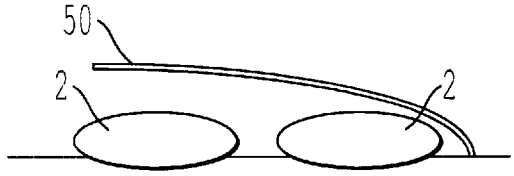
Figure 10B:
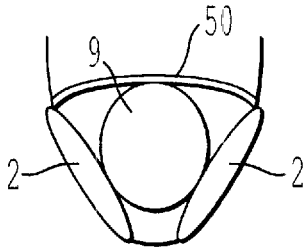
Figure 10D:
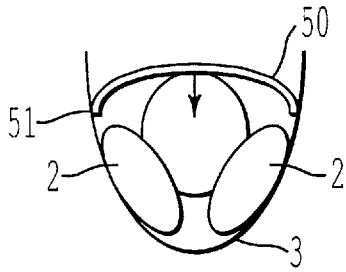
Figure 11A:
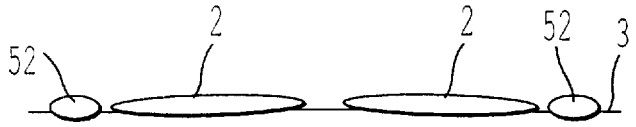
FIG. 11 is a view showing strap bodies and air bags according to still another embodiment, wherein (a) is a developed sectional view, (b) a sectional view showing a condition of use, (c) a developed sectional view at the time of expansion, and (d) a sectional view showing a condition of use at the time of expansion.
Figure 11B:
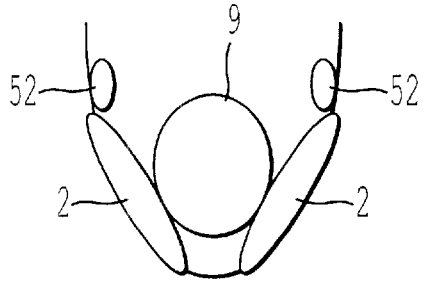
Figure 11C:
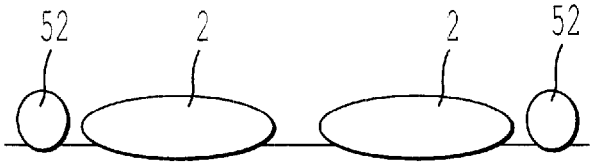
Figure 11D:
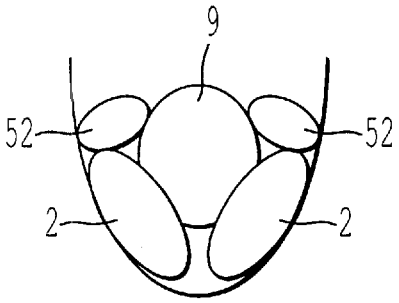

It is also possible to form contact surfaces of the air bags 2 on a side at which they contact the portions to be massaged 9 and surfaces on an opposite side thereof of different materials. In case surfaces on the opposing side are formed of a material which Young's modulus are large and are thus of high rigidity than that of a material employed for forming the contact surfaces, or the surfaces on the opposite side are formed of non-elastic material, degrees of expansion with respect to the portions to be massaged 9 at the time of expansion of the air bags 2 are increased as shown in FIG. 6. Therefore, diffusion of force pressuring the portions to be massaged 9 can be decreased to thereby improve transmitting efficiency.

It is also possible to employ an arrangement in which non-elastic bodies 26 made of fabric or the like are lined to the air bags 2 as shown in FIG. 7 to thereby restrict expansion of surfaces on the opposite side with respect to the portions to be massaged 9. In this case, expansion of the air bags 2 in outward directions can be restricted whereby the transmitting efficiency is improved. Further, it is also possible to employ an arrangement as shown in FIG. 8 wherein each air bag 2 is formed such that it assumes a shape that is anisotropic with an expansion rate in a normal linear direction of inner surfaces of each strap body 3 being large.

As shown in FIG. 9, the air bags 2 and strap bodies 3 may be integrally formed. That is, members constituting the air bags 2 themselves may also constitute the strap bodies 3. In this case, $L'<L$ is satisfied wherein L denotes an entire length of each strap body 3 with the air bags 2 being in shrunk conditions and L' an entire length of each strap body 3 with the air bags 2 being in expanded conditions. Accordingly, in case the air bags 2 are expanded, force F for clamping the portions to be massaged 9 is generated owing to the shrinkage of the entire length whereby massaging effects can be increased through this force in combination with the pressurizing caused through expansion of the air bags 2.

While it may happen that no sufficient pressurizing stimulation can be applied owing to the fact that portions to be massaged 9 are lifted accompanying the expansion of the air bags 2, this can be prevented by providing a fixing means at each of the strap bodies 3 for fixing the portions to be massaged 9. The fixing means as exemplarily shown in FIG. 10 is a fixing belt 50. A tip of the fixing belt 50 which base end is attached to one end of each of the strap bodies 3 is comprised with an engaging means 51 such as a sheet-like fastener for providing engagement at the other end of the strap bodies 3.

FIG. 11 shows an example in which the fixing means are air bags for fixing 52 provided proximate to both ends of the strap bodies 3. The air bags for fixing 52 that are expanded and shrunk simultaneously with the air bags 2 are formed to cover upper surface sides of the portions to be massaged 9 at the time of expansion. With this arrangement, lifting of portions to be massaged 9 can be prevented.

Figure 12:
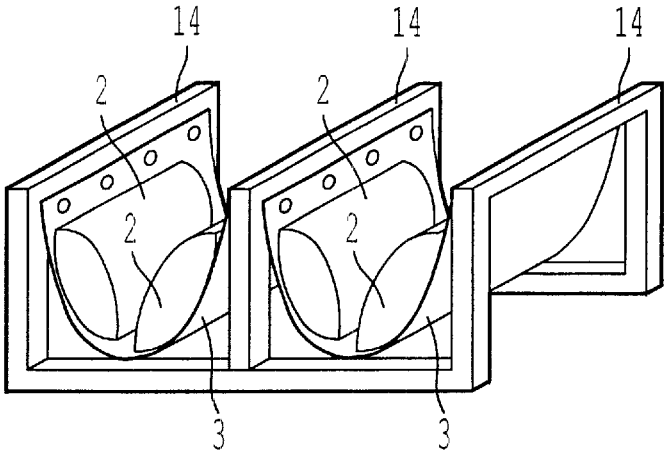
FIG. 12 is a diagonal view showing still another embodiment.
Figure 13:
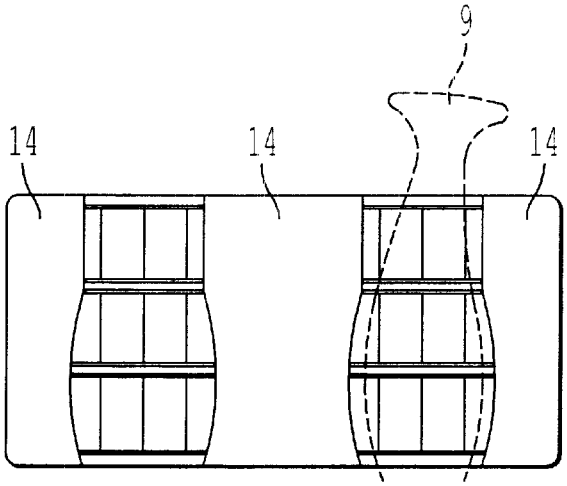
FIG. 13 is a plan view showing still another embodiment.

In another embodiment as illustrated in FIG. 12, the supporting bodies 14 are formed of pipe frames while the strap bodies 3 and air bags 2 are similar to those of the previously described embodiments. Such an arrangement is advantaged in terms of providing a light-weighted structure. Portions to which the strap bodies 3 are attached are preferably formed to assume shapes that fit along shapes of portions of a human body to be massaged 9. An example thereof is shown in FIG. 13. These portions assume shapes that suit legs that become narrower in approaching tip portions (calf portions). Due to the improved fit between the air bags 2 or strap bodies 3 and the portions to be massaged 9, response speed that can be felt by the portions to be massaged 9 by performing expansion and shrinkage of the air bags 2 can be made favorable. In addition, the rate of force transmitted to the portions to be massaged 9 can also be increased.

Figure 14A:
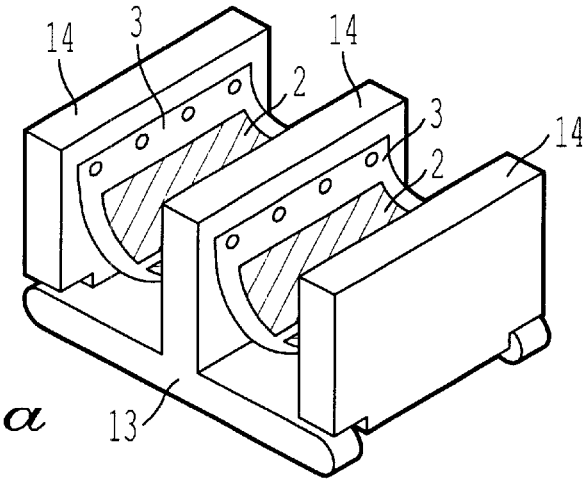
FIG. 14 is a view showing still another embodiment, wherein (a) is a diagonal view and (b) (c) respectively a front view.
Figure 14B:
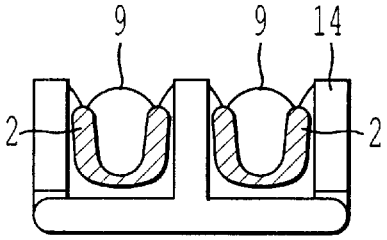
Figure 14C:
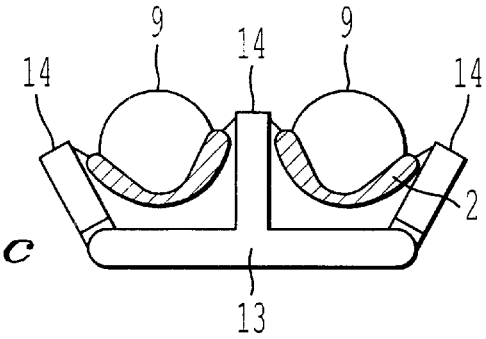

FIG. 14 shows a massage device wherein intervals between the supporting bodies 14 to which both ends of the strap bodies 3 are attached are variable. In the illustrated example, the supporting bodies 14 at both end sides out of the three plate-like supporting bodies 14 are coupled to the bottom plate 13 by means of hinges. Thus, the acceptable range of thickness of portions to be massaged 9 can be increased.

Figure 15:
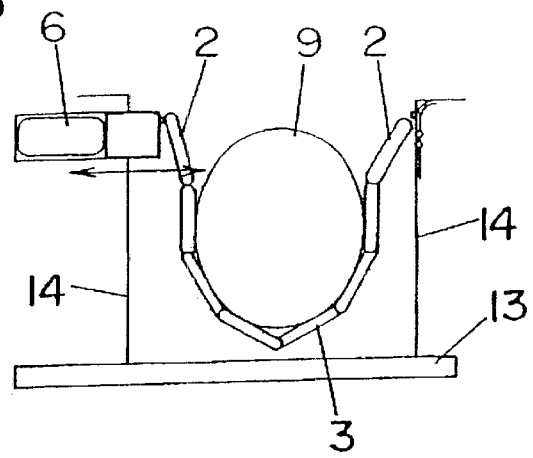
FIG. 15 is a schematic sectional view showing still another embodiment.

In the massage device as shown in FIG. 15, at least one end of the strap bodies 3 is connected to the supporting body 14 via a slide mechanism 6 that is formed at the supporting body 14. The slide mechanism 6 is comprised of, e.g. an air bag or an air cylinder wherein the strap body 3 is attached to a tip end portion thereof that performs sliding movements. By employing such a slide mechanism, the interval between both end portions of the strap body 3 can be varied so that aperture widths can be adjusted as to suit a thickness of the portion to be massaged 9. This adjustment also makes it possible to increase contact areas of the air bags 2 and the strap body 3 with respect to the portion to be massaged 9. Thus, most favorable massage can be constantly performed irrespective of a thickness of portions to be massaged 9, and transmitting efficiency of force can also be improved.

Figure 16:
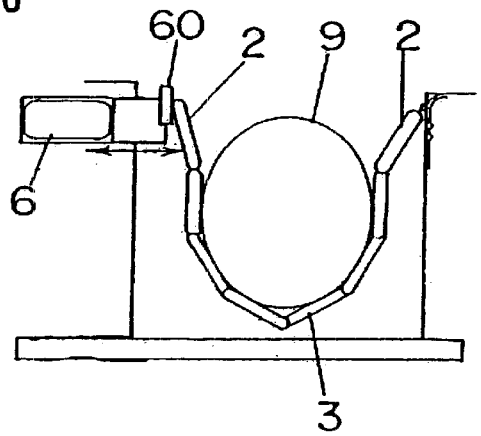
FIG. 16 is a schematic sectional view showing still another embodiment.

In the massage device as shown in FIG. 16, a tip portion of the slide mechanism 6 is provided with a pressure sensor 60 for measuring a pressure generated between the strap body 3 and the slide mechanism. By making the slide mechanism 6 perform sliding movements in an active manner in accordance with output values of the pressure sensor 60, the portion to be massaged 9 can be made to fit against the air bags 2 at a continuously constant force also during massage.

Figure 17:
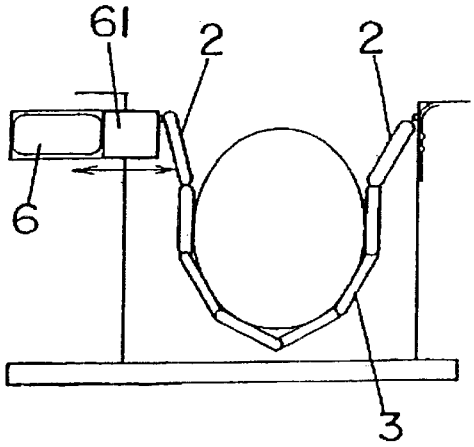
FIG. 17 is a schematic sectional view showing still another embodiment.

The sliding mechanism 6 may also be an arrangement that does not perform sliding movements in an active manner. In this case, the slide mechanism 6 may be formed with a retraction preventing mechanism 61 such as a latchet as shown in FIG. 17, so that positions that have been positioned at an initial stage after starting massage may be maintained also during massage. With this arrangement, it can be prevented that the slide mechanism 6 is pushed back owing to repulsive force from the portion to be massaged 9. It is of course possible to provide the retraction preventing mechanism 61 also at a means including an air cylinder or the like for performing sliding movements in an active manner.

Figure 18:
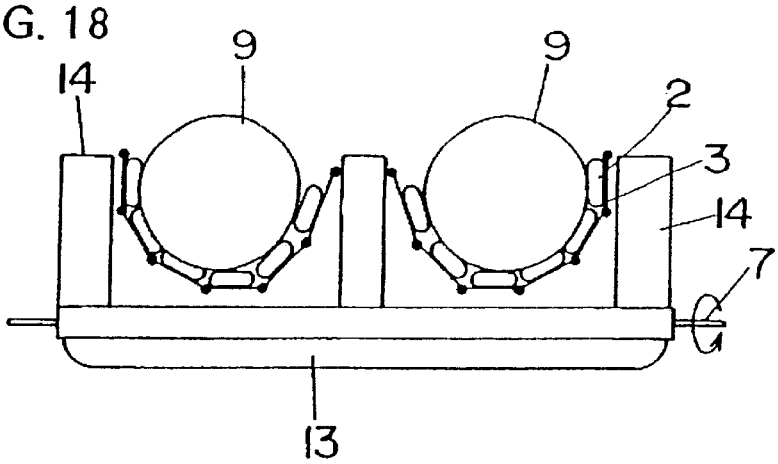
FIG. 18 is a schematic sectional view showing still another embodiment.

The massage device as shown in FIG. 18 is arranged in that the bottom plate 13 is supported by means of a rotating shaft 17 such that the bottom plate may be reversed upside down. When out of use, the substantially flat bottom surface of the bottom plate 13 is faced up by the reversing such that the surface employed for massage can be hidden.

Figure 19:
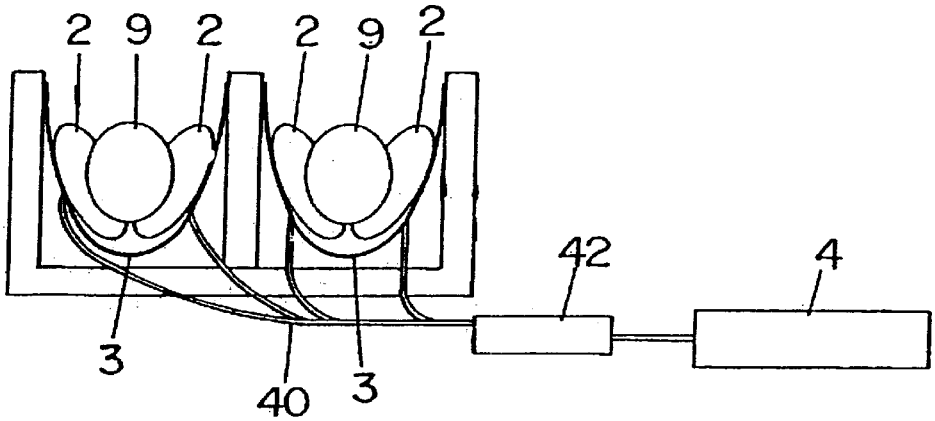
FIG. 19 is a schematic sectional view showing another example of a still another embodiment.
Figure 20:
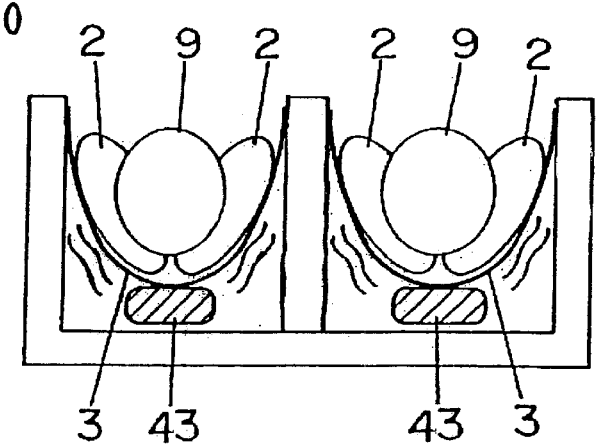
FIG. 20 is a schematic sectional view showing still another embodiment.
Figure 21:
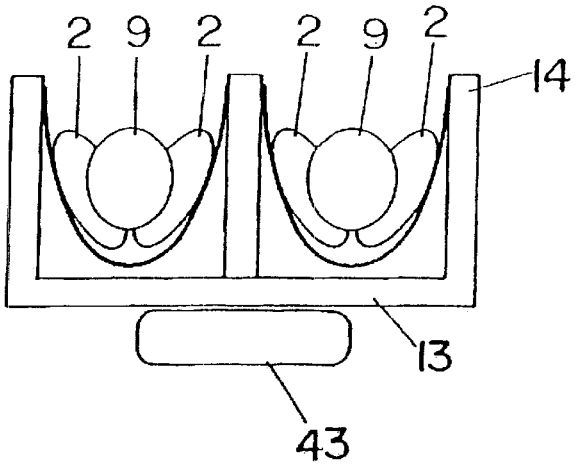
FIG. 21 is a schematic sectional view showing still another embodiment.

While massage is performed by performing expansion and shrinkage of the air bags 2 in each of the above-described massage devices, a separate massaging means may be additionally provided. For instance, bloodstream stimulating effects owing to heat can be obtained by arranging a heater 42 for warming air supplied to the air bags 2 or heating means such as electric heater wires that are embedded in the air bags 2 or strap bodies 3 for warming these as shown in FIG. 19. Further, bloodstream stimulating effects owing to vibrating massage can be obtained by arranging a vibrator 43 to the air bags 2 or strap bodies 3 as shown in FIG. 20 or by arranging the vibrator 43 to the supporting bodies 14 (bottom plate 13) as shown in. FIG. 21.

Figure 22:
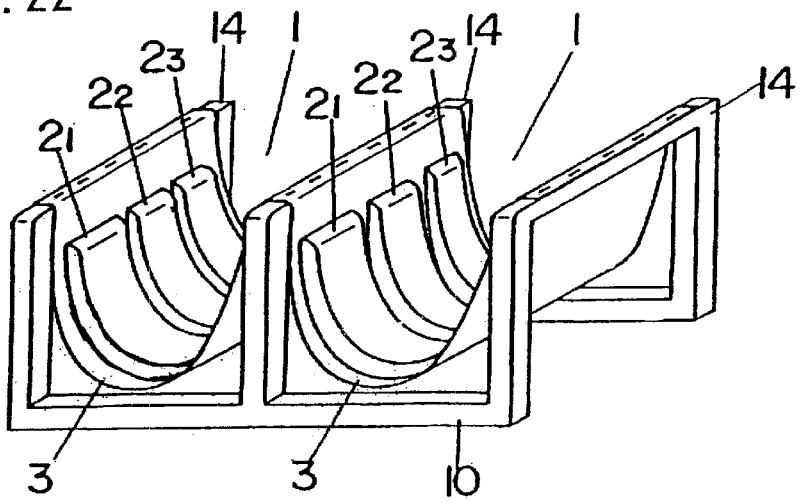
FIG. 22 is a diagonal view showing still another embodiment.

The massage device as shown in FIG. 22 is provided with a plurality of air bags $\mathbf{2}_1$, $\mathbf{2}_2$, $\mathbf{2}_3$ which are attached to the inner surface of the strap bodies 3. These air bags $\mathbf{2}_1$, $\mathbf{2}_2$, $\mathbf{2}_3$ are aligned in the longitudinal direction of massaged portions of a human body such as legs or arms received by the strap bodies 3. These air bags $\mathbf{2}_1$, $\mathbf{2}_2$, $\mathbf{2}_3$ are arranged such that they can be separately expanded and shrunk by the air supply means4. Hereinafter, the above-mentioned longitudinal direction is referred to as axial direction.

Both right and left ends and the central portion in a lateral direction of each strap body 3 are fixed at upper ends of supporting portions 14 which are rising upward from both right and left ends and a central portion in a lateral direction of the body 10 formed of pipe frames such that the strap bodies are suspended between the supporting portions 14,14 to assume U-shaped sections.

Figure 23:
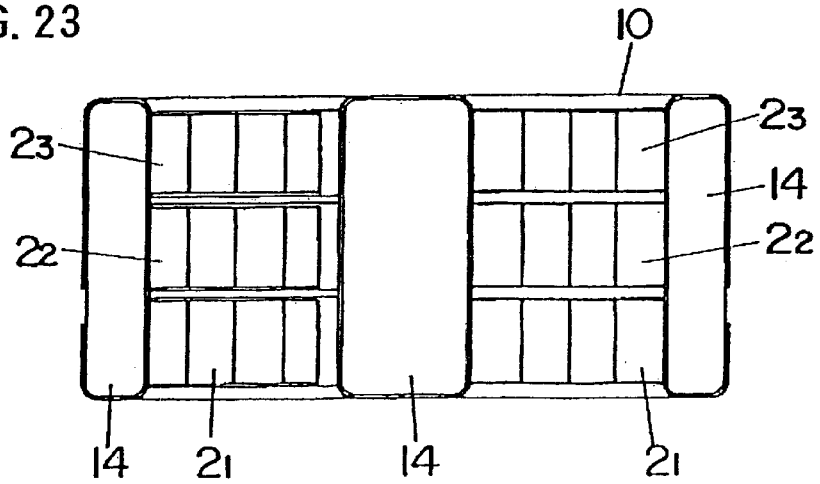
FIG. 23 is a plan view showing still another embodiment.

The air bags $\mathbf{2}_1$, $\mathbf{2}_2$, $\mathbf{2}_3$ are respectively attached to opposing right and left lateral surfaces of inner surfaces of the strap bodies 3 wherein they are aligned in axial directions of the concaved groove portions 1. While the air bags $\mathbf{2}_1$, $\mathbf{2}_2$, $\mathbf{2}_3$ are illustrated in FIG. 22 as to be of a single air chamber structure, respectively, they may also be formed to include a plurality of air chambers that are divided in longitudinal directions of the strap bodies 3 as shown in FIG. 23. However, in view of decreasing the number of piping between these and the air supply means 4, it is preferable that each of these air chambers be mutually in linkage with each other.

Figure 24A:
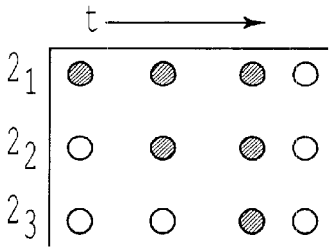
FIGS. 24(*a*)(*b*) is an explanatory view for explaining timings for expansion and shrinking of each of the air bags in the massage device as shown in FIG. 22 or FIG. 23.
Figure 24B:
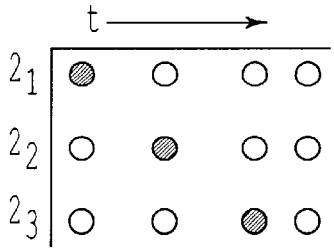

The air bags $\mathbf{2}_1$, $\mathbf{2}_2$, $\mathbf{2}_3$ that are aligned in the axial directions of the concaved groove portions 1 do not simultaneously perform expansion and shrinkage. Rather, after expanding only air bags $\mathbf{2}_1$, the air bags $\mathbf{2}_2$ are expanded whereby two air bags $\mathbf{2}_1$, $\mathbf{2}_2$ are in an expanded condition as shown in FIG. 24(*a*), and thereafter, air bag $\mathbf{2}_3$ is expanded such that all of the air bags $\mathbf{2}_1$, $\mathbf{2}_2$, $\mathbf{2}_3$ are expanded whereupon all of the air bags $\mathbf{2}_1$, $\mathbf{2}_2$, $\mathbf{2}_3$ are shrunk. By arranging the air bag $\mathbf{2}_1$ to be at the side of the tip portion of a leg, the pressuring stimulation performed by expansion of the air bags $2_1$, $2_2$, $2_3$ is made to be a milking massage.

In addition to the above method of gradually increasing the number of air bags $2_1$, $2_2$, $2_3$ that are to be expanded from one end side to another end side, it is also possible to employ an arrangement as shown in FIG. 24(*b*) wherein the air bags are sequentially switched for expansion from one end side to another end side in an axial direction. It is also enabled in this case to perform milking massage for pressurizing veins through pressuring from a tip end of a body to a base end of the body.

In case a plurality of air bags $2_1$, $2_2$, $2_3$ are aligned and expanded accordingly, clearances are formed between these air bags $2_1$, $2_2$, $2_3$ in proximity of each end portion of the air bags $2_1$, $2_2$, $2_3$. Such clearances may cause portions to be formed at portions to be massaged 9 which are not pressurized or which can only receive a small amount of pressure even through the portions to be massaged 9 are located within the concaved groove portions 1.

Figure 25A:
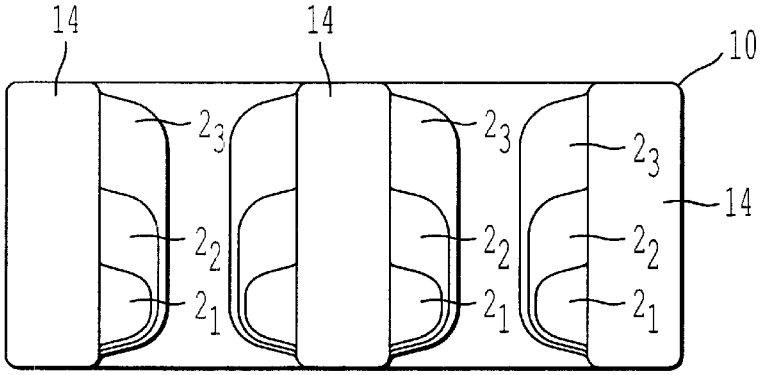
FIG. 25 is a view showing still another embodiment, wherein (a) is a plan view, (b) a front view and (c) a sectional view.
Figure 25B:
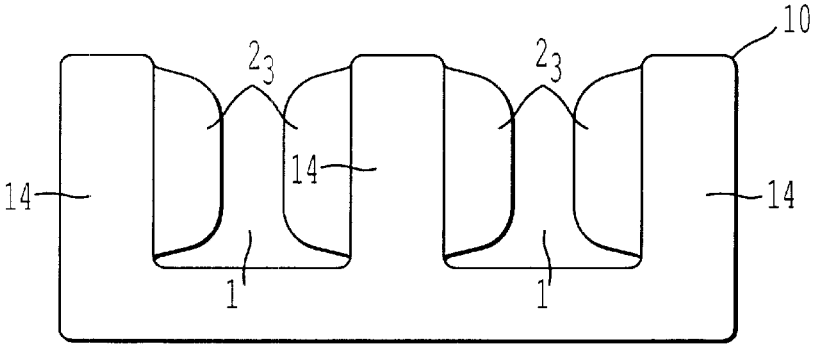
Figure 25C:
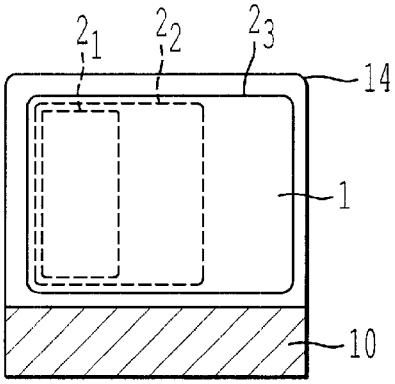
Figure 26:
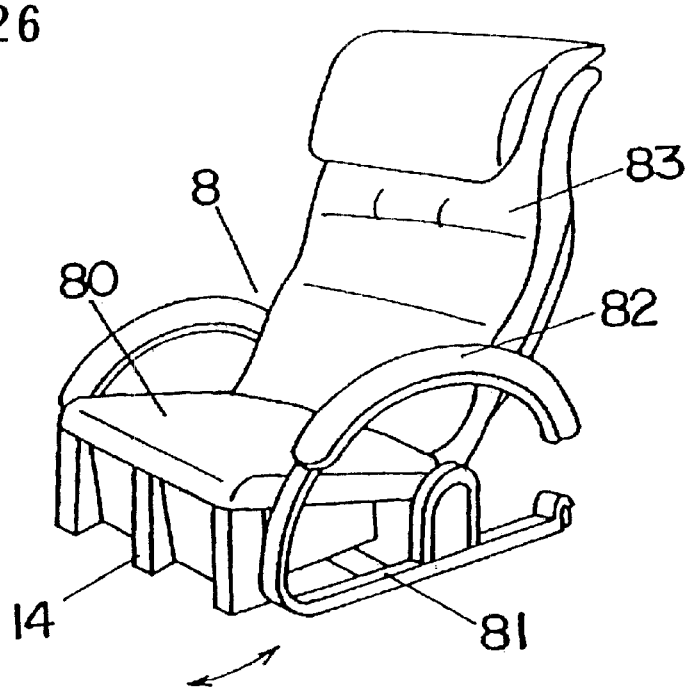
FIG. 26 is a diagonal view of a chair comprised with the massage device according to the present invention.

Thus, the massage device as shown in FIG. 25 is arranged in that the plurality of air bags $2_1$, $2_2$, $2_3$ that are aligned in axial directions of the concaved groove portions 1 are of nesting arrangement. That is, the air bag $2_2$ is accumulated in the air bag $2_3$, and the air bag $2_2$ further accumulates the air bag $2_1$. Note that the inner air bags $2_2$, $2_1$, are located at one end side of the outer air bags $2_3$, $2_2$, and the air bag $2_1$ as well as a portion of the outer air bag $2_3$, $2_2$ at which the inner air bags $2_2$, $2_1$, are not located are aligned in this order in the axial direction of the concaved groove portions 1.

In this massage device, it can be achieved, besides the effect of performing milking massage by utilizing expansion and shrinking of the air bags $2_1$, $2_2$, $2_3$ in the sequence as shown in FIG. 24(*a*), that owing to the fact that no clearances are formed between the air bags $2_1$, $2_2$, $2_3$, it can be prevented that portions that are not pressurized or that receive only small pressuring force are eliminated.

FIGS. 26 to 30 show a chair 8 which is provided with any of the massage devices according to the above-described embodiments at a tip end portion of a seat portion 80 thereof.

The chair 8 is comprised of a frame 81, a seat portion 80, armrests 82 and a back portion 83 provided to be in a freely reclining manner. The massage device is arranged in that the supporting bodies 14 are formed of pipe frames that are attached to the frame 81 by means of a lazy tong mechanism 85.

Figure 27:
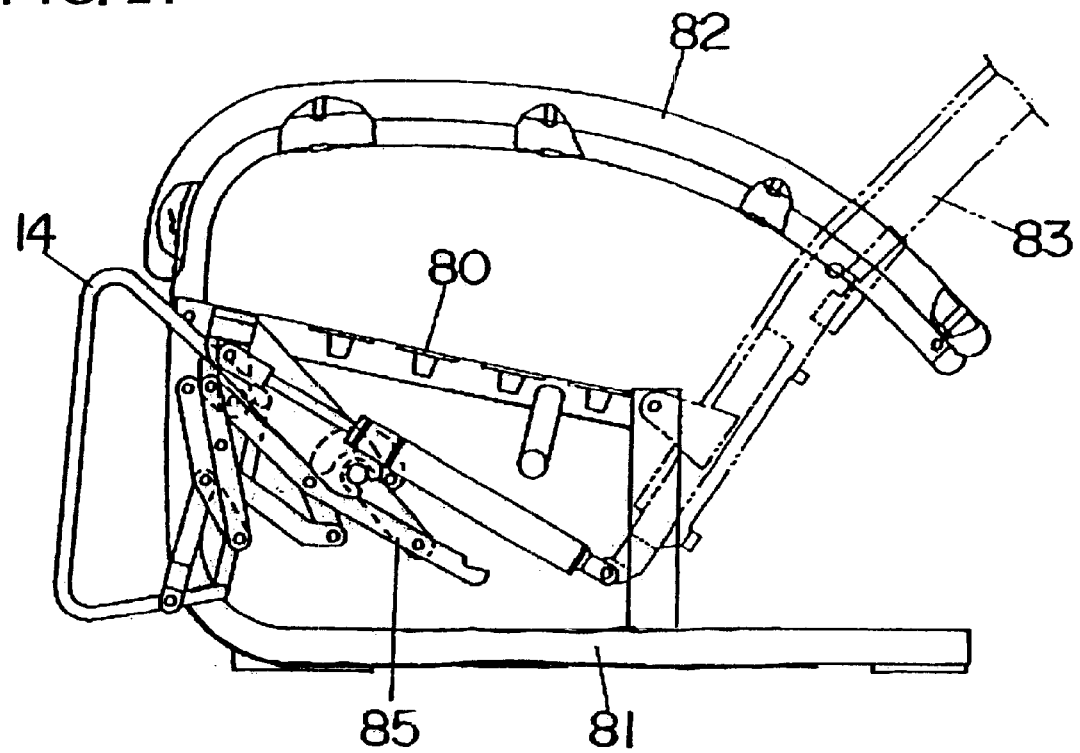
FIG. 27 is a side view showing main portions of the chair as shown in FIG. 26.
Figure 28:
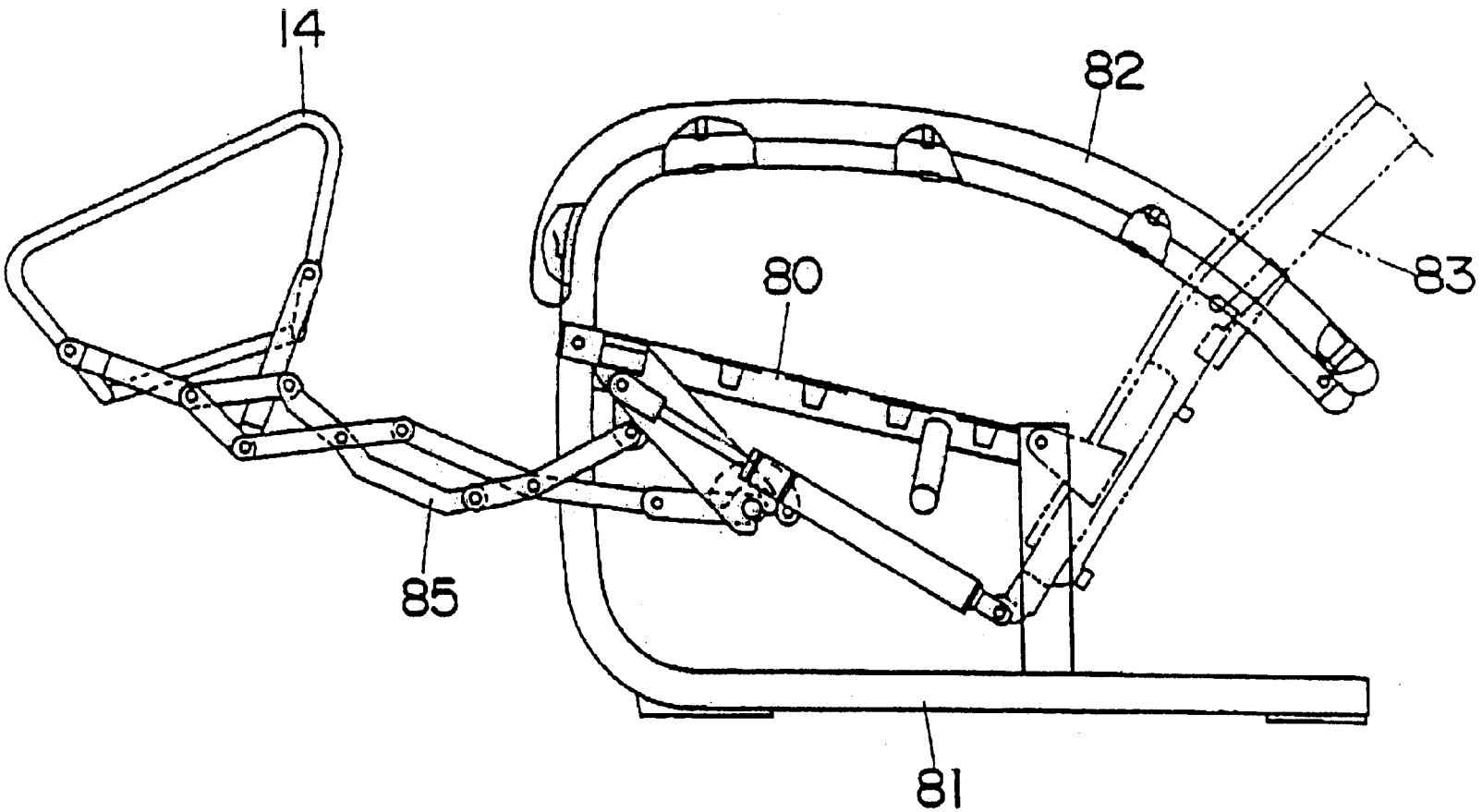
FIG. 28 is a side view showing main portions of the chair as shown in FIG. 26.

In case the lazy tong mechanism 85 is shrunk, the massage device is accumulated below a front-end portion of the seat portion 80 as shown in FIG. 27. In case the lazy tong mechanism 85 is expanded, the massage device is located in front of the seat portion 80. In this manner, it can be switched between a condition in which the massage device is located in front of the seat portion 80 and in which the massage device is an accumulated condition below the front-end portion of the seat portion 80.

In such a case, it is preferable that another massage device be incorporated within the back portion 83 of the chair 8 for performing massage of shoulder, back or waist portions of a human body. In this manner, it can be achieved for quite a favorable arrangement in which massage of back portions of the human body is performed in addition to massage of leg portions and thus relaxing the human body through massaging.

Figure 29:
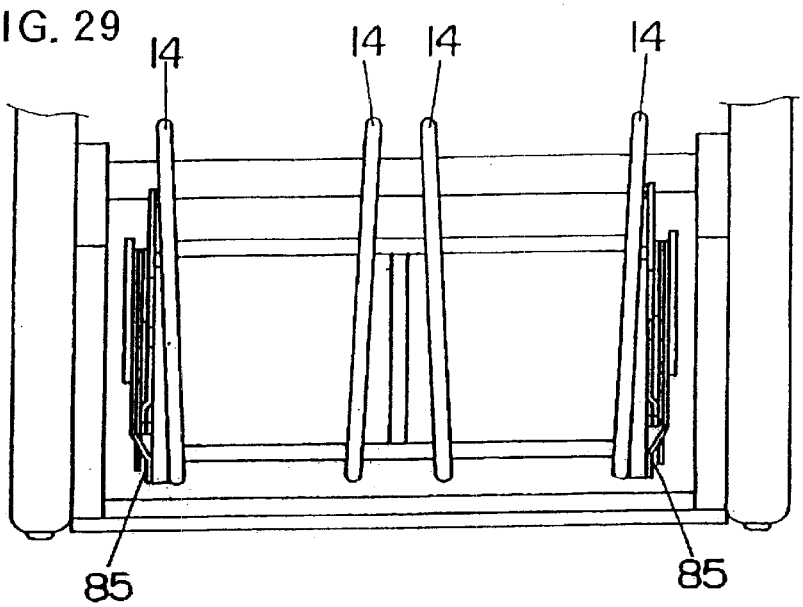
FIG. 29 is a front view showing main portions of the chair as shown in FIG. 26 wherein the massage device is in an accumulated condition.
Figure 30:
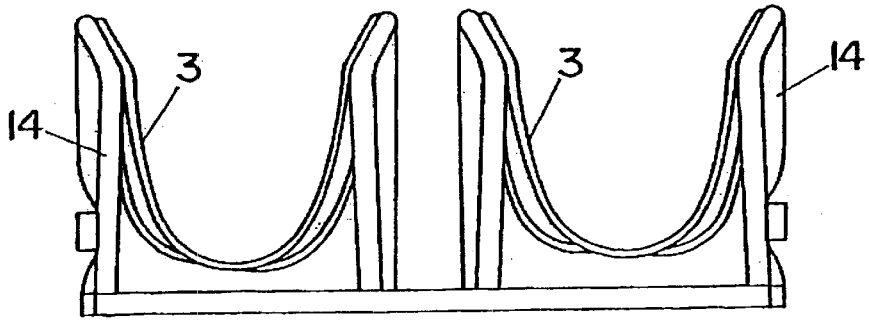
FIG. 30 is a front view of the massage device as shown in FIG. 29.
Figure 31:
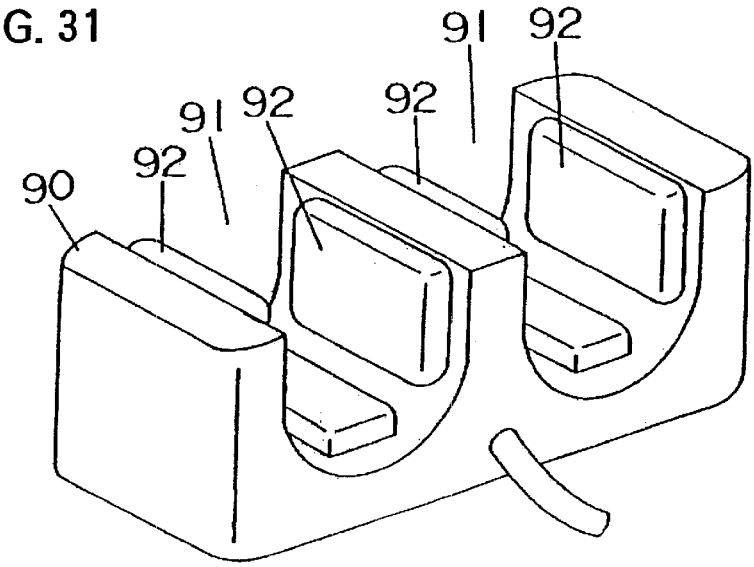
FIG. 31 is a diagonal view of a prior art.

The supporting bodies 14 are for supporting the strap bodies 3 comprised with air bags 2 in a suspending manner as shown in FIG. 30 wherein objects to be massaged are calf portions of legs. Thus, the supporting bodies 14 are accordingly formed, as shown in FIG. 29, in that intervals between tip end sides (lower side in the drawing) are made narrower.

It should be noted that while the massage device according to the present invention is formed as a feet mounting rest 82 in each of the illustrated embodiments, it is also possible to arrange the massage device, for instance, at arm rests 82 for performing massage of arms or at any other portion.

As explained so far, the massage device according to the present invention is comprised of supporting bodies, strap bodies made of pliable material that are respectively attached to the supporting bodies at both end portions thereof so as form U-shaped sections, air bags attached to inner surface sides of the strap bodies for receiving portions of a human body such as legs or arm that are to be massaged, and an air supply means for performing expansion and shrinking of the air bags.

With this arrangement, in case portions to be massaged are located at concaved groove portions that are formed by the strap bodies made of pliable material, the portions to be massaged are held on the strap bodies while the strap bodies assume shapes that fit along shapes of the portions to be massaged. By performing expansion and shrinking of the air bags in this condition, pressure stimulation can be applied to portions to be massaged irrespective of the thickness of the portions to be massaged. Further, the strap bodies suitably fit against the portions to be massaged by simply mounting portions to be massaged on the strap bodies, whereby pressure stimulation can be applied to the portions to be massaged in a constantly favorable manner.

When the air bags are arranged in that they include a plurality of air chambers that are mutually in linkage with each other, it is enabled to decrease the number of air piping. Further, in case the sectional areas of the air passages for connecting respective air chambers are set to be smaller than the sectional areas of the air chambers, fitting characteristics of the air bags with respect to the portions to be massaged can be improved.

Force can be reliably transmitted to the portions to be massaged upon supply of air to the air bags in case of arrangements in which rigidity of surfaces of the air bags that are located at the opposite side with respect to the contact surfaces contacting the portions to be massaged is set to be higher than that of the contact surfaces, in which the surfaces of the air bags that are located at the opposite side with respect to the contact surfaces contacting the portions to be massaged are formed of non-elastic material, or in which the air bags are anisotropic wherein an expansion rate in a normal direction of inner surfaces of the strap bodies is large.

When employing an arrangement wherein in the air bags are uniformly formed with the strap bodies, the entire length of the strap bodies is shortened accompanying the expansion of the air bags, so that clamping force acts on the portions to be massaged to improve massaging effects.

On the other hand, in case of an arrangement in which the strap bodies are formed with fixing means for fixing the portions to be massaged such as belts or air bags for fixing, it can be prevented that the portions to be massaged are lifted so that massaging effects are decreased. Especially in case of employing the air bags for fixing as the fixing means that are expanded and shrunk simultaneously with the air bags that are provided proximate to both ends of the strap bodies, operations for fixing can be eliminated.

In case of forming the supporting bodies of pipe frames, it can be obtained for a light-weighted structure.

In case the shapes of portions of the supporting bodies to which the strap bodies are attached are made to fit along shapes of portions of a human body to be massaged, fitting characteristics of the strap bodies and the air bags with respect to the portions to be massaged can be further improved. Consequently, force can be transmitted to portions to be massaged in a more reliably manner and at a favorable response speed to thereby improve massaging effects. In case the intervals between supporting bodies are variable, the capacity with respect to the thickness of the portions to be massaged can be further increased.

In an arrangement wherein end portions of the strap bodies are fixed to the supporting body by means of a slide mechanism provided at the supporting body, fitting characteristics of the strap bodies and the air bags with respect to the portions to be massaged can be further improved. With this arrangement, force can be transmitted to portions to be massaged in a more reliably manner and at a favorable response speed to thereby improve massaging effects.

In the above case, when employing an arrangement wherein the slide mechanism is arranged to comprise a pressure sensor at its tip and displacements are made in accordance with outputs of the pressure sensor, the air bags are made to fit against the portions to be massaged at a constant force also during massage. In case the slide mechanism is provided with a retraction (preventing) mechanism, the slide mechanism can be prevented from being pushed back owing to repulsive force during massage.

On the other hand, in an arrangement in which the supporting bodies are formed as to be rising from a bottom plate having a substantially flat bottom surface wherein the bottom plate is supported by a rotating shaft for reversing the same upside down, the bottom plate can be reversed to provide an improved design when out of use.

In case the air bags are arranged with heating means for warming air to be supplied to the air bags or heating means are arranged for warming the air bags or strap bodies, bloodstream stimulating effects owing to heat can be achieved. In an arrangement in which vibrators are attached to the air bags, strap bodies or supporting bodies, bloodstream stimulating effects owing to vibration can be achieved.

In an arrangement in which a plurality of air bags are aligned in axial directions of the concaved groove portions wherein each of the air bags are individually provided in a freely expanding and shrinking manner, various massaging methods can be obtained by varying timings for performing expansion and shrinking of each of the air bags to thus perform massage in a more effective manner.

In this case, when the plurality of air bags that are aligned in axial directions of the concaved groove portions are formed to be of a nesting arrangement, that is, in which inner air bags are disposed within outer air bags at end portion sides thereof, no clearances are formed between the air bags. Thus, it can be prevented that portions are not pressurized or that portions receive only a small amount of pressure by the air bags at the time of expansion thereof over the entire portions to be massaged that are located in the concaved groove portions.

In case the actions of the air bags for performing expansion and shrinking are such that the air bags to be expanded are gradually increased from one end side to another end side in the axial direction or such that the air bags to be expanded are sequentially switched from one side to another end side in the axial direction, milking massage for pressurizing veins can be reliably achieved by performing pressurizing from a tip portion of a human body to a base portion of the human body.

In case the massage device of the present invention is formed as a footrest of a chair incorporating therein a different massage device, massage can be performed by the massage body with respect to an upper half of a human body while applying favorable pressurizing stimulation to the legs.

While the preferred embodiments of the present invention have been illustrated in detail, it should be apparent that modifications and adaptations to (of?) those embodiments may occur to one skilled in the art without departing from the scope of the present invention as set forth in the following claims.

What is claimed is:

1. A massage device, wherein the massage device comprises supporting bodies, flexible strap bodies made of pliable material that are attached to upper ends of the supporting bodies to form U-shaped sections configured to flex between the supporting bodies, air bags provided at inner surface of strap bodies for receiving portions of a human body to be massaged, and an air supply means for expanding and shrinking of the air bags.

2. The massage device according to claim 1, wherein the strap bodies are supported by the supporting bodies in a suspending manner.

3. The massage device according to claim 1, wherein mutually independent air bags are disposed on right and left of inner surfaces of the strap bodies.

4. The massage device according to claim 1 wherein the air bags comprise a plurality of linked air chambers that are mutually in linkage with each other.

5. The massage device according to claim 4, wherein cross-sectional areas of the air passages connecting between the air chambers are smaller than cross-sectional areas of the air chambers.

6. The massage device according to claim 1, wherein a rigidity of surfaces of the air bags opposite to contact surface is larger than a rigidity of the contact surfaces.

7. The massage device according to claim 1, wherein surfaces of the air bags opposite to contact surfaces are made of non-elastic material.

8. The massage device according to claim 1, wherein the air bags are uniformly formed with the strap bodies.

9. The massage device according to claim 1, wherein the strap bodies are provided with fixing means for fixing the portions to be massaged.

10. The massage device according to claim 9, wherein the fixing means fix air bags that are simultaneously expanded and shrunk with the air bags that are provide proximate to both ends of the strap bodies.

11. The massage device according to claim 1, wherein the supporting means are formed of pipe frames.

12. The massage device according to claim 1, wherein shapes of portions of the supporting means to which the strap bodies are attached are formed to fit along shapes of portions of a human body to be massaged.

13. The massage device according to claim 1, wherein intervals between supporting bodies are variable.

14. The massage device according to claim 13, wherein an end portion of each strap body is attached to one supporting body by means of a slide mechanism attached to the supporting body.

15. The massage device according to claim 14, wherein a pressure sensor is provided at a tip end of the slide mechanism and the slide mechanism is displaced in accordance with outputs of the pressure sensor.

16. The massage device according to claim 14, wherein the slide mechanism is provided with a retraction preventing mechanism.

17. The massage device according to claim 1, wherein the supporting bodies from a bottom plate having a substantially flat bottom surface and wherein the bottom plate is supported by a rotating shaft for turning the bottom plate upside down.

18. The massage device according to claim 1, wherein heating means warm air that is supplied to the air bags.

19. The massage device according to claim 1, wherein heating means warm the air bags or strap bodies.

20. The massage device according to claim 1, wherein vibrators are provided that are attached to the air bags or strap bodies.

21. The massage device according to claim 1, wherein vibrators are provided that are attached to the supporting bodies.

22. The massage device according to claim 1, wherein a plurality of air bags are provided as to be aligned along the portions of a human body received by the strap bodies at inner surfaces of the strap bodies, and wherein the air bags are provided to be individually expandable and shrinkable in a freely manner.

23. The massage device according to claim 22, wherein the plurality of air bags are of nesting arrangement, and wherein inner air bags are disposed at an end of outer air bags.

24. The massage device according to claim 23, wherein the plurality of air bags are gradually expanded from one end to another end.

25. The massage device according to claim 23, wherein expansion of the plurality of air bags is sequentially switched from one end to another end.

26. The massage device according to claim 1, wherein the massage device is configured to attach to a footrest of a chair which comprises a separate massage device.

27. A massage device according to claim 1, wherein the massage device comprises supporting bodies, flexible means for forming U-shaped sections, air bags provided at inner surfaces of strap bodies for receiving portion of a human body to be massaged, and an air supply means for expanding and shrinking of the air bags.

* * * * *

UNITED STATES PATENT AND TRADEMARK OFFICE

CERTIFICATE OF CORRECTION

PATENT NO. : 6,491,652 B1
DATED : December 10, 2002
INVENTOR(S) : Hitoshi Hata et al.

It is certified that error appears in the above-identified patent and that said Letters Patent is hereby corrected as shown below:

Column 1,
Line 56, after “bodies” delete “for”.

Column 2,
Line 50, change “used” to -- use --.

Column 4,
Line 7, change “denote” to -- denotes --.

Column 5,
Line 50, after “adjusted” delete “as”.

Column 6,
Line 38, change “means4” to -- means 4 --.

Column 9,
Lines 5 and 6, change “reliably” to -- reliable --.

Column 10,
Line 9, change “to (of?)” to -- of --.

Column 12,
Line 17, change “portion” to -- portions --.

Signed and Sealed this

Third Day of February, 2004

JON W. DUDAS
*Acting Director of the United States Patent and Trademark Office*